US006408829B1

(12) United States Patent
Lei et al.

(10) Patent No.: US 6,408,829 B1
(45) Date of Patent: Jun. 25, 2002

(54) FUEL PRESSURE DELAY CYLINDER

(75) Inventors: Ning Lei, Oak Brook; Xilin Yang, Elk Grove Village; James H. Yager, St. Charles; Puning Wei, Lisle; Mark J. Glodowski, Wheeling, all of IL (US)

(73) Assignee: International Engine Intellectual Property Company, L.L.C., Warrenville, IL (US)

( * ) Notice: Subject to any disclaimer, the term of this patent is extended or adjusted under 35 U.S.C. 154(b) by 0 days.

(21) Appl. No.: 09/552,737

(22) Filed: Apr. 19, 2000

Related U.S. Application Data

(60) Provisional application No. 60/129,999, filed on Apr. 19, 1999.

(51) Int. Cl.[7] ..... F02M 37/04
(52) U.S. Cl. ..... 123/501; 123/300
(58) Field of Search ..... 123/446, 500, 123/501, 467, 300, 299

(56) References Cited

U.S. PATENT DOCUMENTS

| | | | | |
|---|---|---|---|---|
| 2,173,814 A | * | 9/1939 | Bischof | 123/300 |
| 3,438,359 A | * | 4/1969 | Thoma | 123/300 |
| 4,289,098 A | * | 9/1981 | Norder | 123/300 |
| 4,671,232 A | * | 6/1987 | Stumpp | 123/300 |
| 5,178,110 A | * | 1/1993 | Guggenbichler | 123/300 |
| 5,492,098 A | | 2/1996 | Hafner et al. | |
| 5,505,384 A | * | 4/1996 | Camplin | 123/300 |
| 5,662,087 A | | 9/1997 | McCandless | |
| 5,720,261 A | | 2/1998 | Sturman et al. | |
| 5,862,792 A | | 1/1999 | Paul et al. | |
| 5,878,720 A | | 3/1999 | Anderson et al. | |

FOREIGN PATENT DOCUMENTS

| | | | | |
|---|---|---|---|---|
| GB | 810456 | * | 3/1959 | 123/300 |

OTHER PUBLICATIONS

C. Cole, O.E. Sturman, D.Giordano, Application of Digital Valve Technology to Diesel Fuel Injection, Society of Automotive Engineers, Inc., 1999–01–0196, pp. 1–7.

* cited by examiner

*Primary Examiner*—Carl S. Miller
(74) *Attorney, Agent, or Firm*—Dennis Kelly Sullivan; Jeffrey P. Calfa; Neil T. Powell

(57) ABSTRACT

A delay device for use with a fuel injector, the fuel injector having an electric controller for controlling the flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device includes an apparatus, shiftable between a first disposition and a second disposition over a certain period of time after initiation of the pulse width command, the period of time effecting a delay in initiation of fuel injection after initiation of the pulse width command. A fuel injector including a delay device. A method of controlling a fuel injection event, includes the steps of flowing an actuating fluid from the controller to an intensifier responsive to a pulse width command, pressurizing a volume of fuel by means of the intensifier, flowing a high pressure fuel from the intensifier to an injector nozzle, and interposing a delay in at least a portion of the flow of fuel to the injector nozzle.

62 Claims, 7 Drawing Sheets

FIG. 2
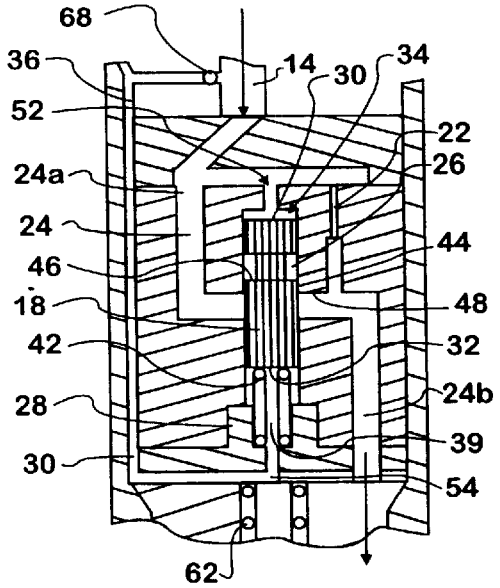
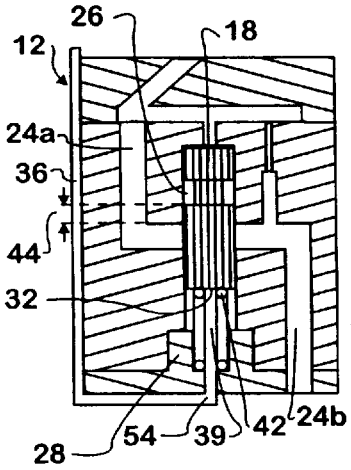
FIG. 2a
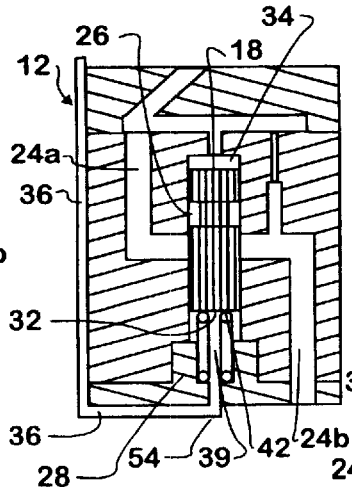
FIG. 2b
FIG. 2c
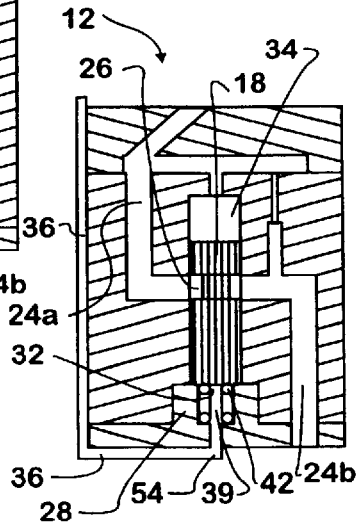

FUEL PRESSURE DELAY CYLINDER

RELATED APPLICATION

The present application claims the benefit of U.S. Provisional Application No. 60/129,999 filed Apr. 19, 1999, and incorporated herein in its entirety by reference.

TECHNICAL FIELD

The present invention relates to fuel injectors for use with internal combustion engines and particularly with diesel engines. More particularly, the present invention relates to hydraulically actuated fuel injectors.

BACKGROUND OF THE INVENTION

Referring to the drawings, FIGS. 5 and 5*a* show a prior art fuel injector 350. The prior art fuel injector 350 is typically mounted to an engine block and injects a controlled pressurized volume of fuel into a combustion chamber (not shown). The prior art injector 350 of the present invention is typically used to inject diesel fuel into a compression ignition engine, although it is to be understood that the injector could also be used in a spark ignition engine or any other system that requires the injection of a fluid.

The fuel injector 350 has an injector housing 352 that is typically constructed from a plurality of individual parts. The housing 352 includes an outer casing 354 that contains block members 356, 358, and 360. The outer casing 354 has a fuel port 364 that is coupled to a fuel pressure chamber 366 by a fuel passage 368. A first check valve 370 is located within fuel passage 368 to prevent a reverse flow of fuel from the pressure chamber 366 to the fuel port 364. The pressure chamber 366 is coupled to a nozzle 372 through fuel passage 374. A second check valve 376 is located within the fuel passage 374 to prevent a reverse flow of fuel from the nozzle 372 to the pressure chamber 366.

The flow of fuel through the nozzle 372 is controlled by a needle valve 378 that is biased into a closed position by spring 380 located within a spring chamber 381. The needle valve 378 has a shoulder 382 above the location where the passage 374 enters the nozzle 378. When fuel flows into the passage 374 the pressure of the fuel applies a force on the shoulder 382. The shoulder force lifts the needle valve 378 away from the nozzle openings 372 and allows fuel to be discharged from the injector 350.

A passage 383 may be provided between the spring chamber 381 and the fuel-port 364 to drain any fuel that leaks into the chamber 381. The drain passage 383 prevents the build up of a hydrostatic pressure within the chamber 381 which could create a counteractive force on the needle valve 378 and degrade the performance of the injector 350.

The volume of the pressure chamber 366 is varied by an intensifier piston 384. The intensifier piston 384 extends through a bore 386 of block 360 and into a first intensifier chamber 388 located within an upper valve block 390. The piston 384 includes a shaft member 392 which has a shoulder 394 that is attached to a head member 396. The shoulder 394 is retained in position by clamp 398 that fits within a corresponding groove 400 in the head member 396. The head member 396 has a cavity which defines a second intensifier chamber 402.

The first intensifier chamber 388 is in fluid communication with a first intensifier passage 404 that extends through block 390. Likewise, the second intensifier chamber 402 is in fluid communication with a second intensifier passage 406.

The block 390 also has a supply working passage 408 that is in fluid communication with a supply working port 410. The supply port is typically coupled to a system that supplies a working fluid which is used to control the movement of the intensifier piston 384. The working fluid is typically a hydraulic fluid that circulates in a closed system separate from the fuel. Alternatively the fuel could also be used as the working fluid. Both the outer body 354 and block 390 have a number of outer grooves 412 which typically retain O-rings (not shown) that seal the injector 350 against the engine block. Additionally, block 362 and outer shell 354 may be sealed to block 390 by O-ring 414.

Block 360 has a passage 416 that is in fluid communication with the fuel port 364. The passage 416 allows any fuel that leaks from the pressure chamber 366 between the block bore 386 and piston 384 to be drained back into the fuel port 364. The passage 416 prevents fuel from leaking into the first intensifier chamber 388.

The flow of working fluid into the intensifier chambers 388 and 402 can be controlled by a four-way solenoid control valve 418. The control valve 418 has a spool 420 that moves within a valve housing 422. The valve housing 422 has openings connected to the passages 404, 406 and 408 and a drain port 424. The spool 420 has an inner chamber 426 and a pair of spool ports that can be coupled to the drain ports 424. The spool 420 also has an outer groove 432. The ends of the spool 420 have openings 434 which provide fluid communication between the inner chamber 426 and the valve chamber 434 of the housing 422. The openings 434 maintain the hydrostatic balance of the spool 420.

The valve spool 420 is moved between the first position shown in FIG. 5 and a second position shown in FIG. 5*a* by a first solenoid 438 and a second solenoid 440. The solenoids 438 and 440 are typically coupled to a controller which controls the operation of the injector. When the first solenoid 438 is energized, the spool 420 is pulled to the first position, wherein the first groove 432 allows the working fluid to flow from the supply working passage 408 into the first intensifier chamber 388 and the fluid flows from the second intensifier chamber 402 into the inner chamber 426 and out the drain port 424. When the second solenoid 440 is energized the spool 420 is pulled to the second position, wherein the first groove 432 provides fluid communication between the supply working passage 408 and the second intensifier chamber 402 and between the first intensifier chamber 388 and the drain port 424.

The groove 432 and passages 428 are preferably constructed so that the initial port is closed before the final port is opened. For example, when the spool 420 moves from the first position to the second position, the portion of the spool adjacent to the groove 432 initially blocks the first passage 404 before the passage 428 provides fluid communication between the first passage 404 and the drain port 424. Delaying the exposure of the ports reduces the pressure surges in the system and provides an injector 350 which has more predictable firing points on the fuel injection curve.

The spool 420 typically engages a pair of bearing surfaces 442 in the valve housing 422. Both the spool 420 and the housing 422 are preferably constructed from a magnetic material such as a hardened 52100 or 4140 steel, so that the hysteresis of the material will maintain the spool 420 in either the first or second position. The hysteresis allows the solenoids 438, 440 to be de-energized after the spool 420 is pulled into position. In this respect the control valve 418 operates in a digital manner, wherein the spool 420 is moved by a defined pulse that is provided to the appropriate solenoid 438, 440. Operating the control valve 418 in a digital manner reduces the heat generated by the solenoids 438, 440 and increases the reliability and life of the injector 350.

In operation, the first solenoid 438 is energized and pulls the spool 420 to the first position, so that the working fluid flows from the supply port 410 into the first intensifier chamber 388 and from the second intensifier chamber 402 into drain port 424. The flow of working fluid into the intensifier chamber 388 moves the piston 384 and increases the volume of chamber 366. The increase in the chamber 366 volume decreases the chamber pressure and draws fuel into the chamber 366 from the fuel port 364. Power to the first solenoid 438 is terminated when the spool 420 reaches the first position.

When the chamber 366 is filled with fuel, the second solenoid 440 is energized to pull the spool 420 into the second position. Power to the second solenoid 440 is terminated when the spool reaches the second position. The movement of the spool 420 allows working fluid to flow into the second intensifier chamber 402 from the supply port 410 and from the first intensifier chamber 388 into the drain port 424.

The head 396 of the intensifier piston 396 has an area much larger than the end of the piston 384, so that the pressure of the working fluid generates a force that pushes the intensifier piston 384 and reduces the volume of the pressure chamber 366. The stroking cycle of the intensifier piston 384 increases the pressure of the fuel within the pressure chamber 366. The pressurized fuel is discharged from the injector 350 through the nozzle opening 372. The actuating fluid is typically introduced to the injector at a pressure between 300–4000 psi. In the preferred embodiment, the piston has a head-to-end ratio of approximately 7:1, wherein the pressure of the fuel discharged by the injector is between 2,000–28,000 psi. The fuel is discharged from the injector nozzle openings 372 and the first solenoid 438 is again energized to pull the spool 420 to the first position and the cycle is repeated.

The prior art HEUI injection system 350 has a relatively quick rise of the injection pressure after initiation of the injection event. As the intensifier piston 384 travels downward under the influence of the actuating fluid, injection pressure builds up very quickly. Under higher actuation fluid pressure (oil pressure), the injection pressure build-up process is abrupt, due to high acceleration of the intensifier piston 384. With the high initial injection pressure of the HEUI injection system 350, the initial rate of the injection is also relatively high and hence contributes to higher NOx emission in an internal combustion engine. As is known, high NOx emission is undesirable as a pollutant. With stringent emission regulations currently being imposed, there is a need in the diesel engine industry to control the initial injection rate so that a gradual rise or rate-shaped injection rate profile can be obtained and the NOx emissions may be favorably affected.

U.S. Pat. No. 5,492,098 presents an invention which improves HEUI injection by adding a spill port at bottom of the plunger. With some spilling of the high pressure fuel at the beginning of the injection, initial injection pressure rises more slowly, hence producing a rate shaping feature. However, due to the spilling of high injection pressure fuel, significant energy is lost to the low pressure fuel reservoir. This loss can not be recovered during the injection event. Such high energy loss is not desirable. It would be advantageous to provide for rate shaping of the rate of fuel injection without significant loss of fuel pressure energy.

SUMMARY OF THE INVENTION

An objective of the present invention is to use a delay device to postpone or slow down the initial injection pressure build up while retaining high fuel pressure energy. With slow initial pressure rising in the injection nozzle chamber, rate shaping can be obtained and controllability of small pilot injection is improved.

Advantages of the present invention are as follows:

Placing a delay device between pressure generation chamber (plunger chamber) and nozzle chamber allows delay of the initial injection pressure rise and tailoring the amount of rate shaping before the main injection event commences. A slow and controllable fuel pressure rise during the initial portion of the injection event is very critical to the precision control of the initial small quantity fuel delivery, especially during a pilot injection mode. Such control further provides repeatability between injection events.

This delay device can be applied to any fuel injection system and specifically is not limited to the HEUI injection system.

The present invention is a delay device for use with a fuel injector, the fuel injector having an electric controller for controlling the flow of a high pressure actuating fluid responsive to initiation and cessation of a pulse width command, the pulse width command defining the duration of an injection event, and an intensifier being in fluid communication with the controller, the intensifier being translatable to increase the pressure of a volume of fuel for injection into the combustion chamber of an engine; the delay device includes an apparatus, shiftable between a first disposition and a second disposition over a certain period of time after initiation of the pulse width command, the period of time effecting a delay in initiation of fuel injection after initiation of the pulse width command. The present invention is further a fuel injector including a delay device. Additionally, the present invention is a method of controlling a fuel injection event, includes the steps of sending a pulse width command to a controller to define an injection event, flowing an actuating fluid from the controller to affect an intensifier responsive to reception of the pulse width command, pressurizing a volume of fuel by means of the intensifier, flowing a high pressure fuel from the intensifier to an injector nozzle, and interposing a delay in at least a portion of the flow of fuel to the injector nozzle.

BRIEF DESCRIPTION OF THE DRAWINGS

FIG. 2 is an enlarged, sectional view of the present invention as depicted in FIG. 1;

FIG. 2*a* is a sectional view of the present invention prior to injection commencement;

FIG. 2*b* is a sectional view of the present invention during pilot injection;

FIG. 2*c* is a sectional view of the present invention during main injection;

DESCRIPTION OF THE PREFERRED EMBODIMENTS

Figure 1:
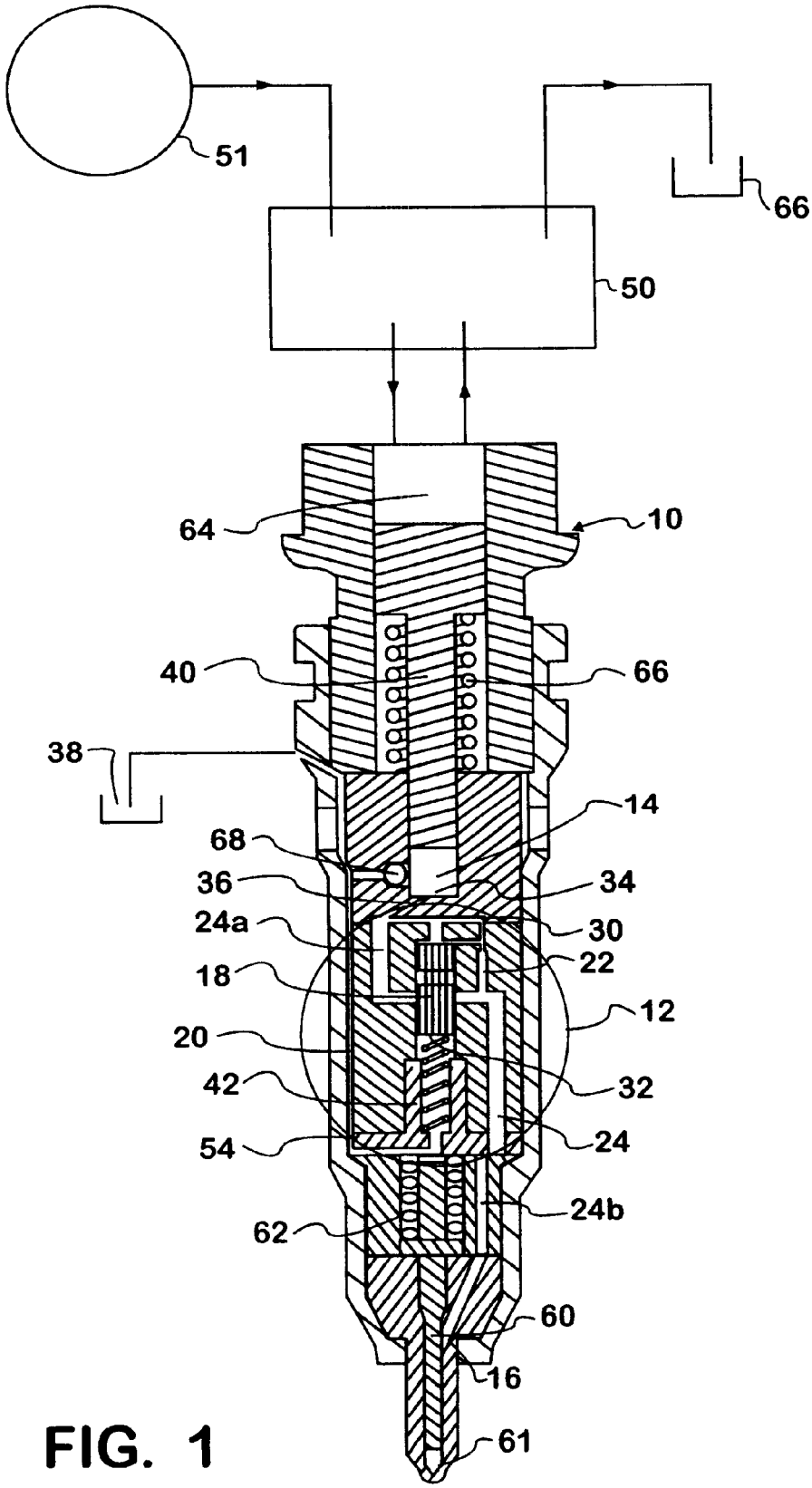
FIG. 1 is a side sectional view of an injector incorporating the delay control means of the present invention, the control portion of the injector being shown schematically.

An exemplary HEUI injector incorporating the present invention is shown generally at 10 in FIG. 1. It is understood that other fuel injectors may also incorporate the present invention. The delay control device 12 of the present invention is installed between the intensifier plunger chamber 14 and the nozzle chamber 16. In a preferred embodiment, the delay control device 12 comprises a delay cylinder 18 and a delay cylinder housing 20, in conjunction with associated fluid passageways, as will be described. The operation of the delay control device 12 is basically such that high pressure fuel flows from the plunger chamber 14 to the nozzle chamber 16 through two different paths, the pilot path 22 and the main path 24. The pilot path 22 is open at all times between the plunger bottom chamber 34 and the nozzle chamber 16. However, the pilot path 22 is relatively restrictive, having a flow area that is less than about 10% of the main path 24. The amount of high pressure fuel flow through the pilot path 22 to the nozzle chamber 16 is therefore relatively limited. The significant fuel flow to the nozzle chamber 16 occurs only when the main path 24 opens up. The main path 24 opening and closing is controlled by the position of the delay cylinder 18 of the delay device 12.

The delay cylinder 18 is translatable between two positions; a closed position, as depicted in FIG. 2*a,* and an open position, as depicted in FIG. 2*c*. Interim positions of the delay cylinder 18 are depicted in FIGS. 2 and 2*b*. The main path 24 of high pressure fuel is blocked when the lower portion 27 of the delay cylinder 18 closes the fuel path between the upper main path 24*a* and the lower main path 24*b*. This occurs when the delay cylinder 18 is at its topmost position (FIG. 2*a*) and in the interim positions (FIGS. 2 and 2*b*). The main path 24 is fully open when delay cylinder 18 is at its bottom stop 28 position (FIG. 2*c*), where the groove 26 (defined in the body of the delay cylinder 18) fully opens the upper main path 24*a* to the lower main path 24*b*.

The delay cylinder 18 has two opposed pressure surfaces 30, 32. The top surface 30 is exposable to high pressure fuel in the control chamber 34 and the bottom surface 32 forms in part a reservoir 39 and is exposable to venting pressure in the low pressure fuel passageway 36. The venting pressure is at the same pressure as low pressure fuel reservoir 38 pressure of FIG. 1. As the intensifier plunger 40 moves downwards, pressure under the plunger 40 in the chamber 14 builds up and a small amount of high pressure fuel flows into the delay cylinder control chamber 34 via the control chambers orifice 52 (see FIG. 2).

The delay cylinder spring 42 acting upward on the delay cylinder 18 is relatively weak. Accordingly, the delay cylinder 18 starts to move downward virtually as soon as the pressure in the control chamber 34 rises (See FIG. 2*b*). As the delay cylinder 18 travels downward, the delay cylinder 18 gradually passes the delay overlap 44 and gradually opens up the main path 24, connecting upper main path 24*a* to lower main path 24*b*. The delay overlap 44 is the distance from the bottom margin 46 of the groove 26 to the top 48 margin of the main path 24 prior to commencing the downward stroke of the delay cylinder 18. See FIG. 2*a*.

Once the main path 24 is open, fuel flow from the plunger chamber 14 to the nozzle chamber 16 will have a rate that is typical of the prior art injector 350. The opening of the main fuel flow path 24 is delayed from the initiation of the flow of the high pressure actuating fluid to the intensifier plunger 40 as controlled by the control valve 50. The delay is equal to the amount of time it takes the delay chamber 18 to travel from its topmost disposition to decrease the overlap amount 44 to zero where the groove 26 commence opening the main path 24. The amount of the delay overlap 44 may be adjusted to fit specific injection system needs by adjusting the distance of the delay overlap 44 during manufacture of the injector. Such adjustment, for example, may be made by increasing the distance from the bottom 46 of the groove 26 to the top 48 (point of intersection with) of the main flow path 24. The delay time may be further adjusted by changing the area of the top pressure surface 30, or by changing the flow area of control chamber orifice 52, or changing the flow area of the drain orifice 54.

The control chamber orifice 52 extends between the high pressure fuel chamber 14 and delay cylinder control chamber 34. The purpose of this orifice 52 is to control the rate of the fuel pressure rising within the control chamber 34. The orifice 52 is used to control the speed of delay cylinder 18 motion by throttling the admission of high pressure fuel to the control chamber 34. If the orifice 52 is relatively large, the delay cylinder 18 moves very fast and main path 24 opening delay becomes nearly negligible. A smaller orifice 52 throttles the high pressure fuel to the control chamber 34, thereby reducing the speed of the downward motion of the delay cylinder 18. The pressure inside of control chamber 34 is preferably lower than the fuel pressure at plunger chamber 14 due to the throttling effect of the orifice 52. As indicated above, the throttling is effected by the relatively small flow area of orifice 52. A lower pressure in the control chamber 34 allows the delay cylinder 18 to move downward with a slower, more controllable and more desirable velocity.

A drain orifice 54 is at the venting (lower) side of the delay cylinder 18 and is fluidly coupled to the bottom pressure surface 32. The orifice 54 is used to vent fuel pressure to the low pressure fuel reservoir 38 when the delay cylinder 18 is moving downward. This orifice 54 purposely restricts the venting process so that the delay cylinder 18 downward motion is damped. Such damping slows down the delay cylinder 18 opening process (FIGS. 2*a* to 2*c*). Varying the flow area of the orifice 54 as desired varies the amount of damping of the delay cylinder 18 and has a direct effect on the duration of the delay time.

The delay cylinder spring 42 is primarily used to return the delay cylinder 18 to its topmost position (FIG. 2*a*) at the end of the injection event after the previously described downward motion of the delay cylinder 18. Accordingly, the spring 42 has a relatively weak spring constant. As long as there is a higher pressure in the control chamber 34 acting downward on the delay cylinder 18 than the pressure in the low pressure fuel reservoir 38 (FIG. 1) pressure (preferably about 50 psi), the delay cylinder 18 will stay at its bottom stop position. Such downward pressure on top pressure surface 30 overcomes the upward bias of the spring 42. Therefore, the closing of the main path 24 can occur at very end of the injection event when the pressure in the control chamber 34 drops to near the pressure in the low pressure fuel reservoir 38 (which is the pressure in reservoir 39). With substantially equal fuel pressure acting on both surfaces 30, 32, the spring 42 is free to return the delay piston 18 to its retracted initial disposition as noted in FIG. 2*a*. The delaying effect of the delay cylinder 18 therefore only occurs at the initial portion of each injection event as described below.

The pilot path 22 connects intensifier plunger chamber 14 to the lower main path 24*b* and to the nozzle chamber 16. The pilot path 22 is used to allow a limited amount of high pressure fuel flow to the nozzle chamber 16 of the needle valve 60 before the main path 24 flow path opens to admit the high pressure fuel for the main fuel injection event. This small amount of initial flow to the nozzle chamber 16 acts to open the needle valve 60 a small amount to permit a small amount of initial fuel injection to occur and provides a rate shaped feature to the injection system prior to main injection. Varying the flow area of the pilot path 22 as desired affects the volume of high pressure fuel flow through the pilot path 22 and therefore affects the rate shaping of the injection event as desired to fit particular application needs.

Description of the Operation

Operation may be appreciated with reference to FIGS. 1 and 2–2*c*. Before the injection event starts, the injector control valve 50 is at its closed position and the intensifier plunger 40 is at its topmost position. The fuel pressure in the passageway 36, the chamber 14, the control chamber 34, the reservoir 39, and at orifice 54 is all at the same pressure, such pressure being the pressure in the low pressure fuel reservoir 38. This pressure is about 50 psi. The delay cylinder 18 of the delay control device 12 is at its topmost position (FIG. 2*a*) due to the upward bias of the spring 42. Initially, the fuel pressure on both surfaces 30, 32 of the delay cylinder 18 is balanced so that the upward bias of the spring 42 alone is affecting the delay cylinder 18 position. The needle valve 60 is also closed under the influence of the spring 62.

Initiation of the injection event is controlled by the control valve 50. As the control valve 50 opens, high pressure actuation fluid from an engine associated high pressure actuation fluid rail 51 flows, at a pressure ranging from 500–3500 psi, into intensifier piston chamber 64 and drives the intensifier plunger 40 downwards against the bias of the return spring 66. Fuel pressure under intensifier plunger 40 in the chamber 14 builds up due to compression of the fuel effected by the force exerted by the high pressure actuation fluid acting on the plunger 40.

A small amount of the increasing pressure fuel flows through the pilot path 22 to the lower main path 24*b* and then further down to the nozzle chamber 16. See FIG. 2*b*. Since the flow volume through the pilot path 22 is very small, the injection pressure at nozzle chamber 16 rises relatively slowly. Such pressure acts to generate an upward directed force on the needle valve 60 and the needle valve 60 is opened only a small amount to permit a small amount of fuel to be injected from orifices 61. Such small injection may be either pilot injection or rate shaping as desired.

At the same time as the pilot injection or rate shaping noted above, a small amount of fuel flows into the delay cylinder control chamber 34 through the orifice 52. The delay cylinder 18 moves downward at a controlled rate against the bias of the spring 42. Since there is offset (delay overlap 44) between the delay cylinder groove edge 46 and the top 48 of main path bore 24, the main path 24 does not start to open until the travel of the delay cylinder 18 is more than the amount of the overlap 44. The opening of the main path is delayed by the time it takes for the travel of the delay cylinder 18 to reduce the overlap 44 amount to zero, which occurs the point where the groove 26 commences to intersect the main path 24.

The main path 24 then starts to open gradually as the groove increasingly intersects the main path 24 after the delay cylinder 18 passes the overlap 44. As soon as the main path 24 begins to open, a significant amount of high pressure fuel flows to the nozzle chamber 16 and causes the needle valve 60 to open fully, resulting in the main injection event. The delay cylinder 18 continues downward until the main path 24 is fully opened as indicated in FIG. 2*c*.

The end of the injection event is also controlled by the control valve 50. The control valve 50 closes to cause the end of the injection event. At such closing, the actuation fluid is vented to ambient pressure at the low pressure reservoir 66. The intensifier plunger 40 starts to return to its top stop position and the injection pressure in the main path 24 available to the needle valve 60 decays. As injection pressure drops, the needle valve 60 is closed by the spring 62. The refill check valve ball 68 starts to open to refill the chamber 14. During the refilling process, the fuel pressure at top surface 30 of the delay cylinder 18 is same (balanced) as the pressure at the bottom surface 32 (about 50 psi fuel reservoir 38 pressure). The delay cylinder spring 42 now starts to push the delay cylinder 18 upward to return the delay cylinder 18 to top stop position (FIG. 2*a*) to complete the injection cycle.

It should be noted that the delay cylinder spring 42 has a very small initial load and spring rate. This allows the delay cylinder 18 to stay at its bottom disposition until the pressure in the control chamber 34 goes substantially low during the end of an injection event. This feature is desirable for dwell control of a split injection event when the control valve makes two round trips. Although the first injection (pilot injection) is delayed, the main injection will not be delayed which causes an increase of dwell time between the pilot injection and the main injection.

Alternative Preferred Embodiments

Push Pin Design

Figure 3A:
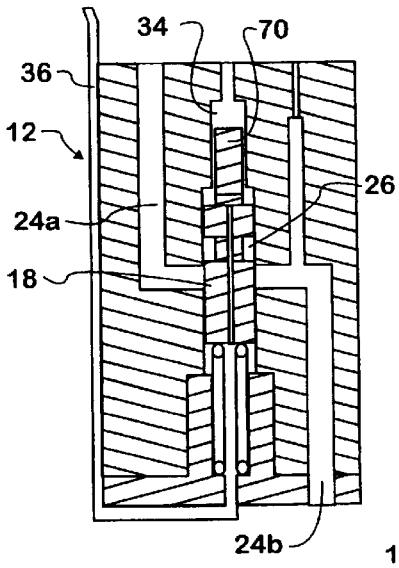
FIG. 3*a* is a sectional view of a further embodiment of the present invention during pilot injection.
Figure 3B:
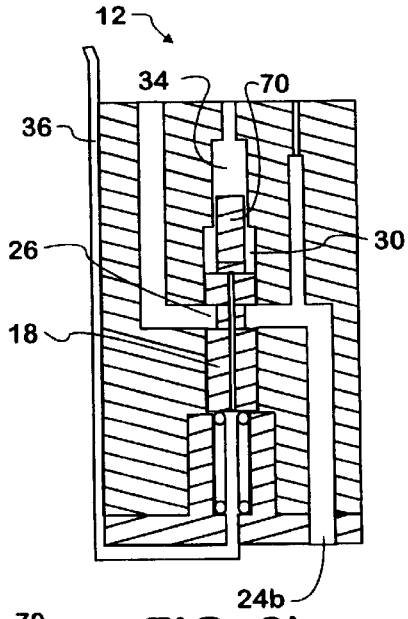
FIG. 3*b* is a sectional view of the embodiment of FIG. 3*a* during main injection.
Figure 3C:
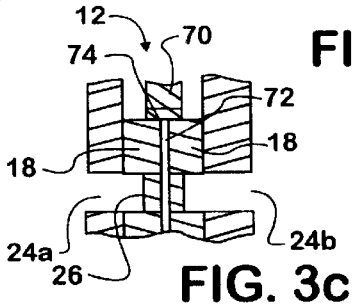
FIG. 3*c* is a sectional view of the present invention depicted in the circle 3*c* of FIG. 3*b;*

This further preferred embodiment of the delay control means 12 is used to minimize the total amount of fuel used during retraction of the delay piston 18, as indicated in FIGS. 3*a*–3*c*. As the delay piston 18 moves downward (translating between the position of FIG. 3*a* to the position of FIG. 3*b*), the delay piston 18 creates displacement in the control chamber 34 and therefore requires some additional amount of the fuel to fill the control chamber 34. It is very desirable that this amount of the fuel should be minimized for energy efficiency concerns. Fuel used to drive the delay piston 18 is not available for injection into the engine combustion chamber. A small pin 70 is used to push the delay cylinder 18 during the downward opening process. This pin 70 can be designed much smaller than is possible with the control chamber 34 of the above embodiment of FIGS. 2. Accordingly, the volume of the control chamber 34 is minimized and hence the amount of fuel used to cause translation of the delay piston 18 is substantially smaller. This increases the volume of fuel available for injection by needle valve 60. Referring to FIG. 3*c*, there is a drain hole 72 at center of the delay cylinder. Together with the transverse slot 74 at bottom of the pin 70, the drain hole 72 balances the pressure on both sides of the delay cylinder 18.

Delayed Pilot Hole Design

Figure 4A:
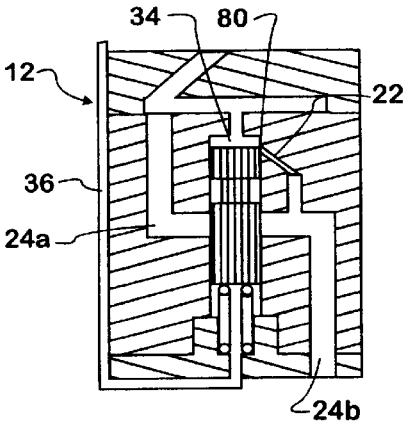
FIG. 4*a* is a sectional view of another embodiment of the present invention prior to pilot injection.
Figure 4B:
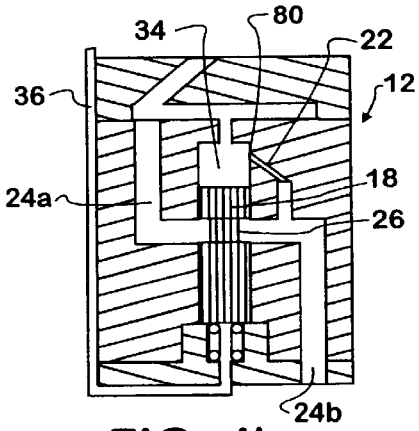
FIG. 4*b* is a sectional depiction of the present invention as depicted in FIG. 4*a* during main injection.

Referring to FIGS. 4*a* and 4*b,* the pilot hole 80 of the pilot path 22 draws fuel from the delay cylinder control chamber 34. The pilot hole 80 is covered by the delay cylinder 18 when delay cylinder 18 is at topmost position. See FIG. 4*a*. As the delay cylinder 18 travels downward, the pilot hole 80 is uncovered and exposed to the fuel under pressure in the chamber 34. The uncovering occurs prior to the opening of the main path 24. This is evident in FIG. 4*b*. The distance between pilot hole 80 and main path 24 defines the amount of rate shaping that will occur before the main injection event occurs. Rate shaping occurs during the time that the pilot path 22 alone is supplying fuel to the needle valve. Such fuel flow in the pilot path 22 commences only after the pilot hole 80 is uncovered and continues as the only source of fuel to the needle valve 60 until the groove 26 of the delay cylinder 18 intersects the main path 24, at which time the main injection event commences.

Spool Cylinder Design

Figure 5:
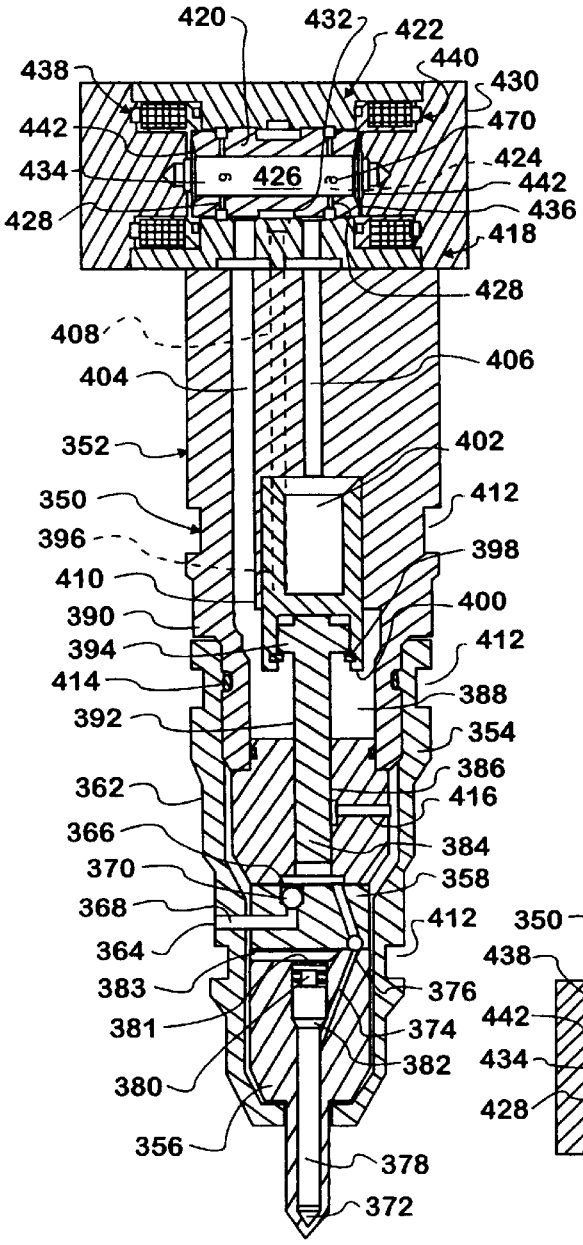
FIG. 5 PRIOR ART
FIG. 5 is a sectional view of a prior art fuel injector.
Figure 5A:
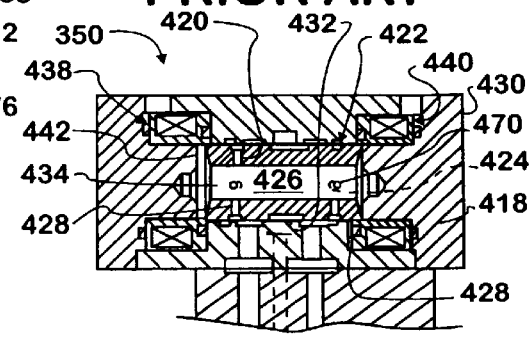
FIG. 5a PRIOR ART
FIG. 5*a* is a sectional view of a prior art fuel injector electrically actuated controller.
Figure 6:
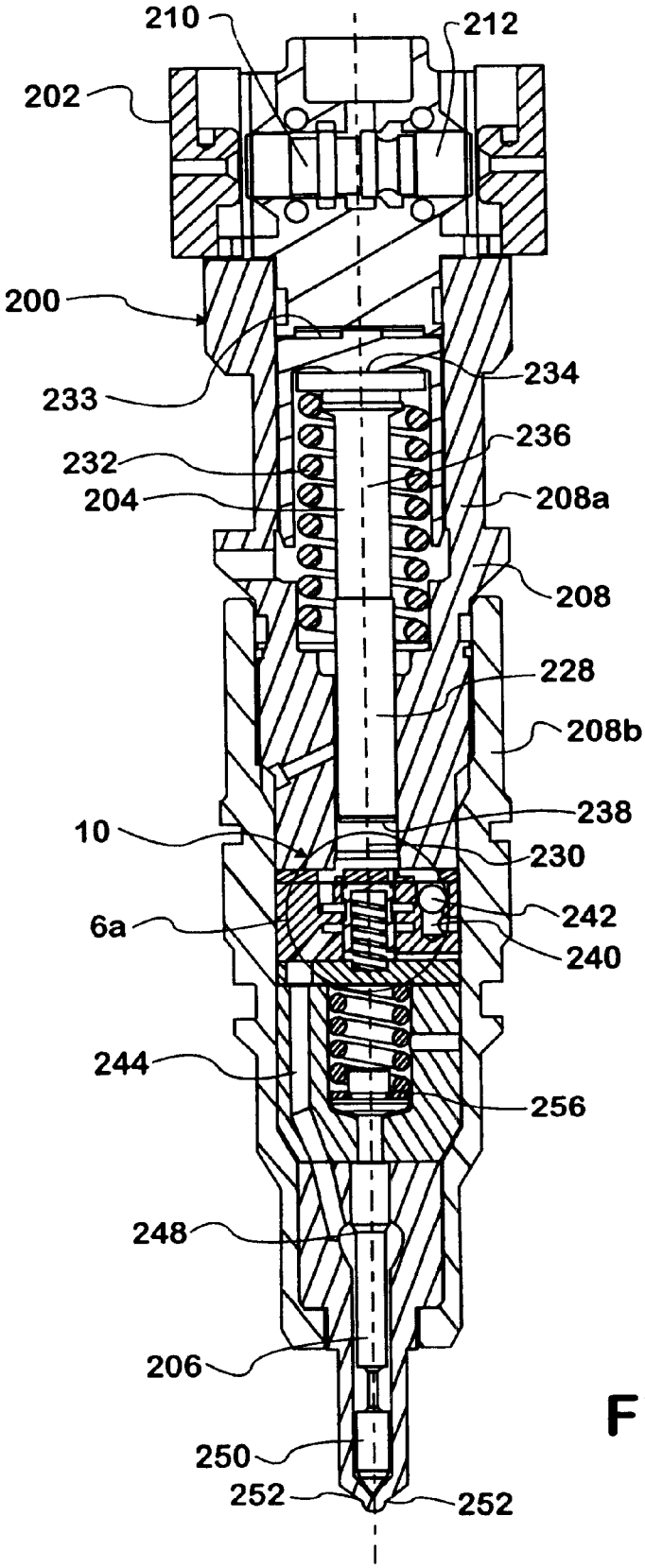
FIG. 6 is a sectional view of an injector with an embodiment of the present invention having rate shaping features.
Figure 6A:
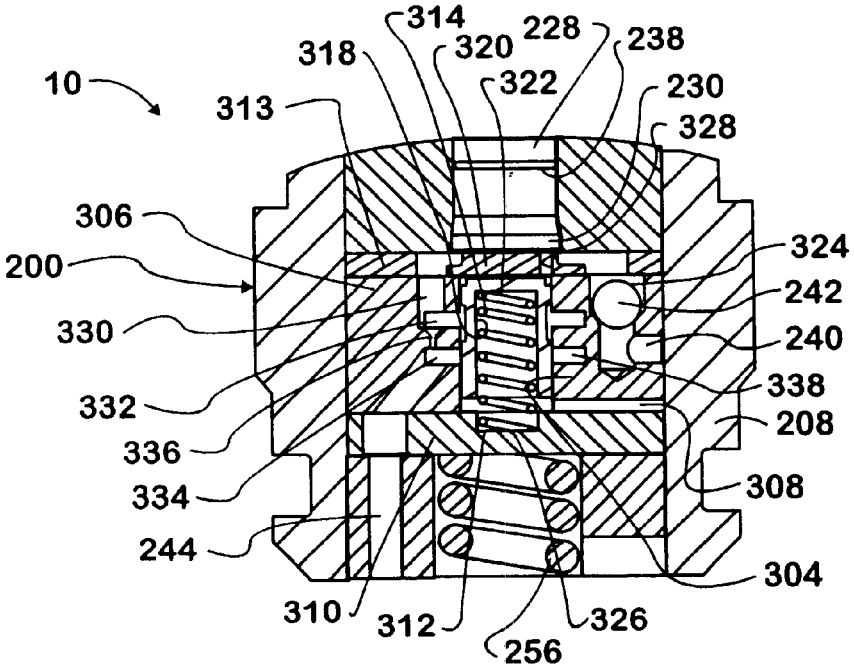
FIG. 6*a* is a sectional view of the delay device of FIG. 6 taken along the circle 6*a;*

A further embodiment of the present invention is depicted in FIGS. 6, 6*a,* and 6*b*. The injector of FIG. 6 is a HEUI type injector substantially as described with respect to the prior art injector 350 of FIGS. 5 and 5*a*.

Ignoring the delay device 10 of the present invention, the injector 200 has four main components: control valve 202, intensifier 204, nozzle 206, and injector housing 208. The injector housing 208 may be formed of several components such as housing 208*a,* housing 208*b,* or be made as a unitary housing.

The control valve 202 initiates and ends an injection event. The control valve 202 has a spool valve 210 and an electric control 212 for shifting the spool valve 210 from a right closed disposition to a left open disposition and return to the right closed seat. The spool valve 210, responsive to electric inputs, ports high pressure actuating fluid to and from the intensifier 204.

To begin injection, a solenoid of the electric control 212 is energized, moving the spool valve 210 from its right closed seat to its left open seat. This action admits high pressure actuating fluid via internal passages (not shown) to the piston chamber 223 of the intensifier 204. As will be seen, absent the delay device 10, fuel injection commences substantially simultaneously with the porting of the high pressure actuating fluid to the intensifier 204 and continues until a solenoid of the electric control 212 is energized and the spool valve 210 is shifted rightward to its right closed seat. Actuating fluid and fuel pressure within the injector 200 then decrease as spent actuating fluid is discharged from injector 200 by the spool valve 210. Such discharge is typically to the valve cover area of the engine, which is at ambient pressure.

The center segment of the injector 200 includes the intensifier 204. The intensifier 204 includes a preferably unitary device comprising the hydraulic intensifier piston 236 and plunger 228, in addition to the fuel chamber 230 and the plunger return spring 232.

Intensification of the fuel pressure to a desired injection pressure level is accomplished by the ratio of areas between the upper surface 234 of the intensifier piston 236, acted on by the high pressure actuating fluid, and the lower surface 238 of the plunger 228, acting on the fuel in the chamber 230. The intensification ratio can be tailored to achieve desired injection characteristics. Fuel is admitted to chamber 230 through the passageway 240 past check valve 242. Injection begins as the high pressure actuating fluid is supplied to the upper surface 234 of the intensifier piston 236, driving the intensifier piston 236 downward to compress the fuel in chamber 230.

As the intensifier piston 236 and plunger 228 move downward responsive to the force exerted by the high pressure actuating fluid, the pressure of the fuel in chamber 230 below the plunger 228 rises dramatically. Absent the delay device 10 of the present invention, the chamber 230 is directly fluidly coupled to the passageway 244. High pressure fuel from the chamber 230 flows through the passageway 244 to act upwardly on the needle valve surface 248. The upward force on the surface 248 overcomes the bias of the needle valve spring 256 and opens the needle valve 250. Fuel is then discharged from the orifices 252 into the combustion chamber of the engine. The intensifier piston 236 continues to move downward and compressing the fuel in chamber 230 until a solenoid of the electric control 212 is energized causing the spool valve 210 to shift rightward to its closed right seat. In such disposition, the high pressure actuating fluid bearing on the surface 234 is discharged from the injector 200 to ambient pressure. At this point, the plunger return spring 232 returns the piston 236 and plunger 228 to their initial upward seated position. As the plunger 228 returns upward, the plunger 228 draws replenishing fuel into the plunger chamber 230 across the ball check valve 242.

The nozzle 206 is typical of other diesel fuel system nozzles. Fuel is supplied to the nozzle orifices 252 through internal passages 244. As indicated above, the dramatic rise in fuel pressure to the nozzle needle 250 acts to lift to the needle 250 to the open position, thereby allowing fuel injection to occur through orifices 252. As fuel pressure decays at the end of the injection event, responsive to the rightward shift of the spool valve 210, the spring 256 returns the nozzle needle 250 to its upward closed disposition.

Figure 6B:
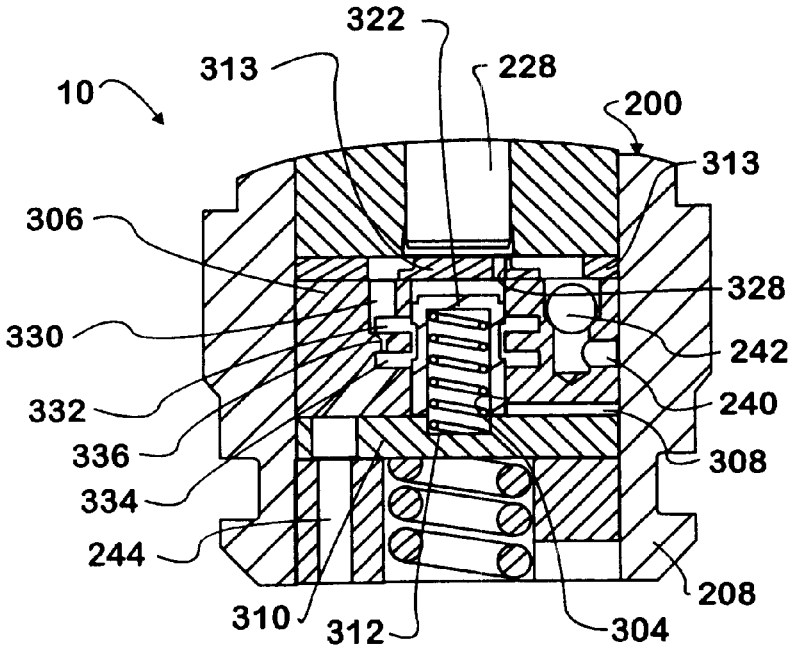
FIG. 6*b* is a sectional view of the delay device of FIG. 6*a* during main injection.

The imposition of the delay device 10 in the injector 200 has a dramatic effect on the aforementioned injection process as will be described in greater detail below. As best shown in FIG. 6*a* and 6*b,* the delay device 10 includes the following components: piston assembly 300 and flow passage assembly 302. The flow passage assembly 302 includes a cylinder 304 defined in the housing 306. Cylinder 304 has a drain passage 308 defined proximate the lower margin of the cylinder 304. The drain passage 308 is typically vented exterior of the injector 200 to fuel supply pressure (50 psi). The drain passage 308 is preferably defined between the housing 306 and the delay cylinder stop 310. The delay cylinder stop 310 has a generally circular spring retainer groove 312 defined therein.

The delay piston assembly 300 includes a delay piston 314 translatably disposed within the cylinder 304. The delay piston 314 is biased to the upward disposition as depicted in FIG. 6*a* by a return spring 316. The return spring 316 resides in an axial chamber 318 defined within the delay piston 314. A distal end of the return spring 316 is captured within the spring retainer groove 312.

The delay piston 314 has a top surface 320 that is exposable to high pressure fuel. The top surface 320 has a centrally disposed return orifice 322 defined therein. The return orifice 322 extends between top surface 320 and the axial chamber 318. A circumferential groove 324 is defined around the body of the delay piston 314. The groove 324 is spaced apart from the top surface 320. The delay piston 314 further has a lower margin 312. As depicted in FIG. 6*b,* the lower margin 312 is in contact with the delay cylinder stop 310 in the fully open disposition of the delay piston 314.

The flow passage assembly 302 further includes a plurality of flow passages as will be described. The first such flow passage is the control chamber orifice 328. The control chamber orifice extends between the plunger chamber 230 and the cylinder 304. High pressure fuel flowing from the plunger chamber 230 through the control chamber orifice 328 bears on the top surface 320 of the delay piston 314.

The main path 330 has a substantially larger flow passageway than the control chamber orifice 328. The main path 330 is also fluidly connected to the plunger chamber 230 and is defined at least in part in the housing 306 alongside the delay piston 314. The main path 330 is defined in part through the delay cylinder stop 310 and in part in the housing 306. The main path 330 is fluidly coupled to an upper groove 332 that is also defined in the housing 306. The upper groove 332 is circumferential about the center axis of the delay piston 314. The upper groove 332 intersects and is fluidly coupled to the cylinder 304. A second groove, the lower groove 334 is spaced apart from and immediately beneath the upper groove 332. Like the upper groove 332, the lower groove 334 is defined in the housing 306 circumferential to the delay piston 314. The lower groove 334 intersects the cylinder 304.

Where rate shaping is desired, a relatively small area pilot path 336 is defined in the housing 306 extending between and fluidly coupling the upper groove 332 and the lower groove 334. It is understood that where delay alone is desired, the pilot path 336 would not be included. As will be seen, the delay overlap 338 is defined between the lower margin of the groove 324 and the upper margin of the lower groove 334.

Operation of the delay device 10 may be appreciated with reference to FIGS. 6*a* and 6*b*. FIG. 6*a* shows the delay piston 314 at its uppermost disposition within the cylinder 304. This position is the position and defines the status prior to initiation of the injection event. The lower groove 334 is substantially sealed by the wall of the delay piston 314. Accordingly, fuel may flow from the upper groove 332 to the lower groove 334 only through the pilot path 336. The drain passage 308 is fully open.

Upon initiation of the injection event by the control valve 202, high pressure actuating fluid is ported to the intensifier 204. The plunger 228 starts downward dramatically compressing the fuel in the plunger chamber 230. The high pressure fuel flows through the control chamber orifice 328 to bear upon the top surface 320 of the delay piston 314 and thereby to commence downward translation of the delay piston 314.

Simultaneously, high pressure fuel flows through the main path 330, the upper groove 332, and the pilot path 336. The limited amount of high pressure fuel passing through the pilot path 336 flows through the lower groove 334 to the passageway 244. This limited amount of high pressure fuel acts to open the needle valve 250 to slightly open the orifices 252, resulting in the injection of a very limited amount of fuel into the compression chamber. The limited amount of fuel injected results in a gradual ramping of the rate of injection into the combustion chamber, comprising the desired rate shaping of the leading edge of the main injection event.

It should be understood that by not including the optional pilot path 336, no injection occurs during the aforementioned described period of delay. In such event, no high pressure fuel is admitted to the flow passageway 244 until the delay cylinder 314 completes the transition through the delay overlap 338.

When the delay piston 314 translates downward enough to complete the translation through the region of the delay overlap 338, the groove 324 defined in the delay piston 314 intersects both the upper groove 332 and the lower groove 334 permitting full flow of high pressure fuel from the plunger chamber 230 to the fuel passage 244 to fully open the needle valve 250, resulting in the main injection portion of the injection event. The delay piston 314 continues downward under the influence of the force generated on the top surface 320 by the high pressure fuel until the lower margin 326 comes into contact with the delay cylinder stop 310 as depicted in FIG. 6*b* At this lower disposition, drain passage 308 is completely blocked by the delay piston body 314.

Termination of the injection event is commanded by the control valve 202. An electric signal to the control valve 202 shifts the spool valve 210 from the left open seat to the right closed seat. Such shifting vents the high pressure actuating fluid from the injector 200. The intensifier 204 ceases to pressurize fuel in the plunger chamber 230. The plunger 228 commences its upward travel. At this point, the delay piston 314 commences its upward travel from the lower open seat of FIG. 6*b* to the upper closed seat of FIG. 6*a*. Such translation is effected by the bias generated on the delay piston 314 by the return spring 316. As the delay piston 314 translates upward, fuel captured within the cylinder 304 above the delay piston 314 passes through the return orifice 322 and out the drain passage 308. The delay piston 314 continues upward until the top surface 320 is seated on the underside of the spacer 313 as depicted in FIG. 6*a*.

The control chamber orifice 328 has a significant effect on the motion of the delay piston. If the control chamber orifice 328 is extremely small, the motion of the delay piston 314 will be very slow resulting in a longer delay time. The delay piston return spring 316 is relatively weak So that return of the delay piston occurs only when the pressure in the plunger chamber 230 decays nearly to the fuel supply pressure level (50 psi).

Figure 7B:
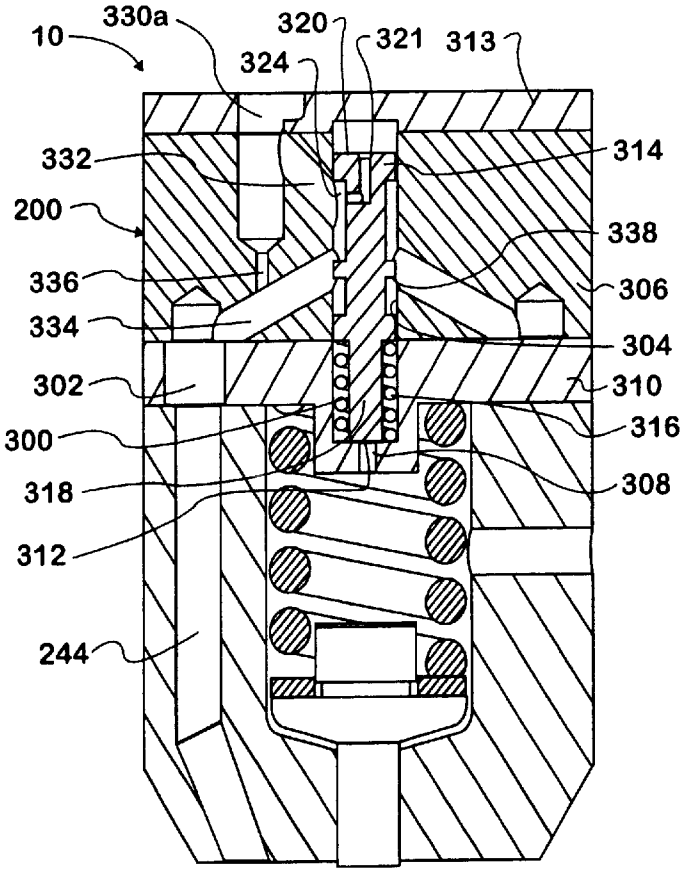
FIG. 7*b* is a sectional view of the delay device of FIG. 6*a* during main injection.
Figure 7A:
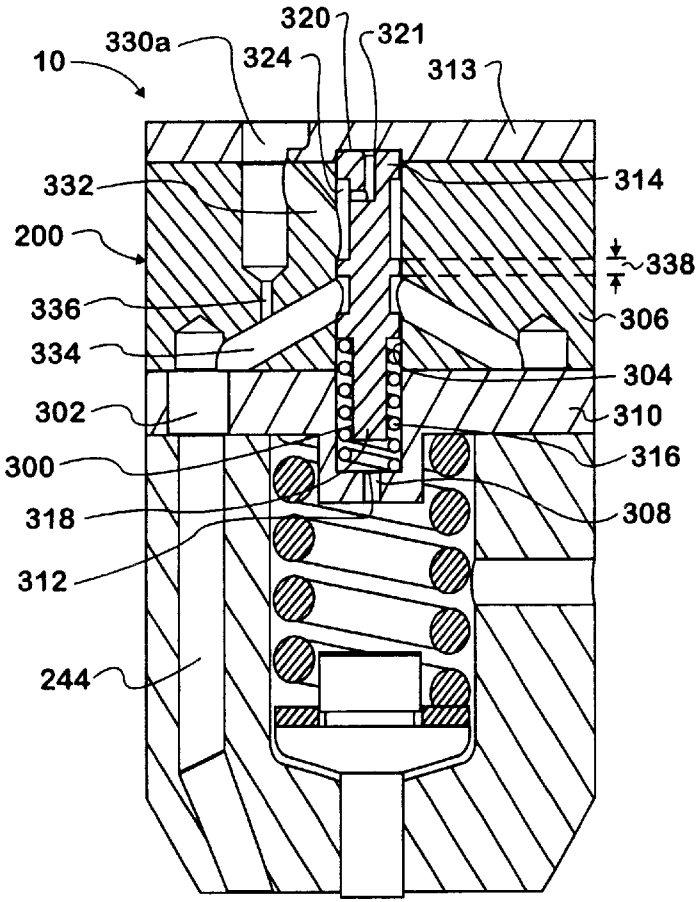
FIG. 7*a* is a sectional view of an alternative embodiment of the delay device depicted in the closed disposition.

A further embodiment of the present invention is depicted in FIGS. 7*a* and 7*b*. The concept of the delay device of FIGS. 7*a* and 7*b* is similar to the embodiment described above with respect to FIGS. 6*a* and 6*b* and may be readily installed in the injector 200 of FIG. 6. Accordingly, like numbers in the FIGS. 7*a* and 7*b* denote like components in FIGS. 6*a* and 6*b*. The delay device 10 includes components piston assembly 300 and flow passage assembly 302.

The flow passage assembly 302 includes a cylinder 304 defined in the housing 306. Cylinder 304 has a drain passage 308 defined proximate the lower margin of the cylinder 304. The drain passage 308 is typically vented exterior to the injector 200 to fuel supply pressure. The drain passage 308 is preferably defined between the housing 306 and the delay cylinder stop 310. The delay piston stop 310 has a generally circular spring retainer groove 312 defined therein.

The piston assembly 300 includes a delay piston 314 translatably disposed within the cylinder 304. The delay piston 314 is biased in the upward disposition as depicted in FIG. 7*a* by a return spring 316. The return spring 316 is concentrically disposed with respect to a depending cylinder 318 of the delay piston 314.

The delay piston 314 has a top surface 320 that is exposable to high pressure fuel. The top surface 320 has a centrally disposed inlet orifice 321 defined therein. The inlet orifice 321 extends between top surface 320 and a circumferential groove 324 that is defined around the body of the delay piston 314. The groove 324 is spaced apart from the top surface 320. The delay piston 314 further has a lower margin 312. As depicted in FIG. 7*b,* the lower margin 312 is in contact with the delay cylinder stop 310 in the fully open disposition of the delay piston 314.

The flow passage assembly 302 further includes a plurality of flow passages as will be described. The first such flow passage is the main path 330. The upper main path 330*a* is fluidly connected to the plunger chamber 230 and the lower main path 334 is fluidly connected to the passage 244 to the nozzle orifices 252. The upper main path 330*a* is fluidly coupled to an upper path extension 332 that is also defined in the housing 306. The upper path extension 332 is intersects and is fluidly coupled to the groove 324 in the piston 314 and thence through an inlet orifice 350 to the inlet 321. The size of inlet orifice 350 can be varied to adjust the velocity of the delay piston 314. A second lower path extension 334 is spaced apart from and immediately beneath the upper path extension 332. The lower path extension 334 intersects the cylinder 304. An axially symmetric drilled passage 334*a* is placed on the other side from extension 334 to reduce the hydraulic side loading on the delay piston since the hydraulic pressure in passages 334 and 334*a* are always the same.

Where rate shaping is desired, a relatively small flow area pilot path 336 is defined in the housing 306 extending between and fluidly coupling the upper main path 330*a* and the lower path extension 334. It is understood that where delay alone is desired, the pilot path 336 would not be included. As will be seen, the delay overlap 338 is defined by the width of a land 337 of the delay piston 314 that, in FIG. 7*a,* spans the gap between intersections with the cylinder 304 respectively of the upper path extension 324 and the lower path extension 334.

Operation of the delay device 10 may be appreciated with reference to FIGS. 7*a* and 7*b*. FIG. 7*a* shows the delay piston 314 at its uppermost disposition within the cylinder 304. This position is the position and defines the status prior to initiation of the injection event. The lower path extension 334 is substantially sealed from the upper path extension by the land defining the delay overlap 338. Accordingly, fuel may flow from the chamber 230 in the injector 200 (see FIG. 6) through the upper main path 330*a,* the upper path extension 332 and to the inlet 321 to bear on the surface 320. Simultaneously, high pressure fuel may flow from the upper main path 330*a* through the pilot path 336 to the lower main path 330*b* and thence to the orifices 252 for pilot injection. The drain passage 308 is fully open.

Upon initiation of the injection event by the control valve 202, high pressure actuating fluid is ported to the intensifier 204. The plunger 228 starts downward dramatically compressing the fuel in the plunger chamber 230 and providing high pressure fuel to the upper main path 330*a*. The high pressure fuel flows through the inlet 321 to bear upon the top surface 320 of the delay piston 314 and thereby to commence downward translation of the delay piston 314.

Simultaneously, high pressure fuel flows through the main path 330*a* and the pilot path 336. The limited amount of high pressure fuel passing through the restricted flow area of the pilot path 336 flows through the lower path extension 334 and the lower main path 330*b* to the passageway 244. This limited amount of high pressure fuel acts to open the needle valve 250 to slightly open the orifices 252, resulting in the injection of a very limited amount of fuel into the compression chamber. The limited amount of fuel injected results in a gradual ramping of the rate of injection into the combustion chamber, comprising the desired rate shaping of the leading edge of the main injection event.

It should be understood that by not including the optional pilot path 336, no injection occurs during the aforementioned described period of delay. In such event, no high pressure fuel is admitted to the flow passageway 244 until the delay cylinder 314 completes the transition through the delay overlap 338.

When the delay piston 314 translates downward enough to complete the translation through the region of the delay overlap 338, the groove 324 defined in the delay piston 314 intersects both the upper path extension 332 and the lower path extension 334 permitting full flow of high pressure fuel from the plunger chamber 230 to the fuel passage 244 to fully open the needle valve 250, resulting in the main injection portion of the injection event. The delay piston 314 continues downward under the influence of the force generated on the top surface 320 by the high pressure fuel until the lower margin 312 comes into contact with the piston stop 310 as depicted in FIG. 7*b*.

It should be understood that by adjusting the length of the overlap 338, the size of the inlet orifice 350, and/or the size of the pilot passage 336, different rate shaping effects can be obtained. The optimum combination will be determined empirically from engine performance testing.

Termination of the injection event is commanded by the control valve 202. An electric signal to the control valve 202 shifts the spool valve 210 from the left open seat to the right closed seat. Such shifting vents the high pressure actuating fluid from the injector 200. The intensifier 204 ceases to pressurize fuel in the plunger chamber 230. The plunger 228 commences its upward travel. At this point, the delay piston 314 commences its upward travel from the lower open seat of FIG. 7*b* to the upper closed seat of FIG. 7*a*. Such translation is effected by the bias generated on the delay piston 314 by the return spring 316. As the delay piston 314 translates upward, fuel captured within the cylinder 304 above the delay piston 314 passes through the inlet orifice 321 and out the drain passage 308. The delay piston 314 continues upward until the top surface 320 is seated on the underside of the spacer 313 as depicted in FIG. 7*a*.

While a number of presently preferred embodiments of the invention have been illustrated and described, it should be appreciated that the inventive principles can be applied to other embodiments falling within the scope of the following claims.

What is claimed is:

1. A fuel injector, comprising:

an electric controller for controlling the flow of a high pressure actuating fluid responsive to initiation and cessation of a pulse width command, the pulse width command defining the duration of an injection event;

an intensifier being in fluid communication with the controller, the intensifier being translatable to increase the pressure of a volume of fuel in a plunger chamber for injection into the combustion chamber of an engine, the intensifier having an intensifier piston disposed in a cylinder defined in an injector housing;

an injector nozzle in fluid communication with the intensifier;

a delay device in fluid communication with the intensifier and the injector nozzle, being shiftable between a first disposition and a second disposition over a certain period of time after initiation of the pulse width command, the period of time effecting a delay in initiation of at least a portion of the fuel injection from the injector nozzle after initiation of the pulse width command, the delay device including a delay piston translationally disposed in a delay piston cylinder defined at least in part in the injector housing, actuation of the delay device being effected by a flow of selectively throttled pressurized fuel.

2. A fuel injector, comprising;

an electric controller for controlling the flow of a high pressure actuating fluid responsive to initiation and cessation of a pulse width command, the pulse width command defining the duration of an injection event;

an intensifier being in fluid communication with the controller, the intensifier being translatable to increase the pressure of a volume of fuel in a plunger chamber for injection into the combustion chamber of an engine, the intensifier having an intensifier piston disposed in a cylinder defined in an injector housing;

an injector nozzle in fluid communication with the intensifier;

a delay device in fluid communication with the intensifier and the injector nozzle, being shiftable between a first disposition and a second disposition over a certain period of time after initiation of the pulse width command, the period of time effecting a delay in initiation of at least a portion of the fuel injection from the injector nozzle after initiation of the pulse width command, the delay device including a delay piston translationally disposed in a delay piston cylinder defined at least in part in the injector housing a first actuating high pressure fuel passageway, the first actuating fuel passageway fluidly coupling the plunger chamber to the delay piston, fluid pressure in the first actuating fuel passageway acting to generate a force on the delay piston for imparting translatory motion thereto, the first actuating fuel passageway providing a predetermined restriction controlling the application of the fluid pressure to impart the translatory motion to the delay piston.

3. A delay device for use with a fuel injector, the fuel injector having an electric controller for controlling the flow of a high pressure actuating fluid responsive to initiation and cessation of a pulse width command, the pulse width command defining the duration of an injection event, and an intensifier being in fluid communication with the controller, the intensifier having a plunger chamber, and being translatable to increase the pressure of a volume of fuel in the plunger chamber, the plunger chamber being in fluid communication with an injector nozzle, the injector nozzle for injection of fuel into the combustion chamber of an engine; the delay device comprising:

an apparatus, shiftable between a first disposition and a second disposition over a certain period of time after initiation of the pulse width command, the period of time effecting a delay in initiation of fuel injection after initiation of the pulse width command, actuation of the delay device being effected by a flow of selectively throttled pressurized fuel.

4. The delay device of claim 3 wherein the electric controller is shiftable between a closed disposition and an open disposition, the delay in initiation of fuel injection being related to a period of time necessary for the electric controller to complete a round trip between the closed disposition and the open disposition.

5. The delay of claim 3 further effecting rate shaping of the injection event.

6. The fuel injector of claim 3 further effecting pilot injection prior to a main injecting portion of the injection event.

7. The delay device of claim 3 being fluidly interposed between the intensifier and the injector nozzle to affect the fluid communication between the intensifier and the injector nozzle.

8. The delay device of claim 7 wherein the apparatus acts to delay the flow of high pressure fuel from the intensifier to the injector nozzle.

9. The delay device of claim 3 wherein the apparatus is biased is the first disposition.

10. The delay device of claim 9 wherein the apparatus shifts from the first disposition responsive to high pressure fuel generating a force on the apparatus in opposition to the bias.

11. The delay device of claim 10 wherein the apparatus is disposed relative to a fluid passageway, the fluid passageway being in fluid communication with the injector nozzle, such that shifting of the apparatus acts to open and close the passageway.

12. The delay device of claim 11 wherein the apparatus is a piston disposed in a cylinder, the fluid passageway intersecting the cylinder.

13. The delay device of claim 12 wherein the piston is biased in the first disposition.

14. The delay device of claim 13 wherein the piston is translatably disposed at least in part in a cylinder defined in an injector housing.

15. A fuel injector, comprising:

an electric controller for controlling the flow of a high pressure actuating fluid responsive to initiation and cessation of a pulse width command, the pulse width command defining the duration of an injection event;

an intensifier being in fluid communication with the controller, the intensifier being translatable to increase the pressure of a volume of fuel for injection into the combustion chamber of an engine;

a delay device, shiftable between a first disposition and a second disposition over a certain period of time after initiation of the pulse width command, the period of time effecting a delay in initiation of fuel injection after initiation of the pulse width command, actuation of the delay device being effected by a flow of selectively throttled pressurized fuel.

16. The fuel injector of claim 15 wherein the electric controller is shiftable between a closed disposition and an open disposition, the delay in initiation of fuel injection being related to a period of time necessary for the controller to complete a round trip between the closed disposition and the open disposition.

17. The fuel injector of claim 15 further effecting rate shaping of the injection event.

18. The fuel injector of claim 15 further effecting pilot injection prior to a main injection portion of the injection event.

19. The fuel injector of claim 15 being fluidly interposed between the intensifier and an injector nozzle to affect the fluid communication between the intensifier and the injector nozzle.

20. The fuel injector of claim 19 wherein the delay device acts to delay the flow of high pressure fuel from the intensifier to the injector nozzle.

21. The fuel injector of claim 15 wherein the delay device is biased in the first disposition.

22. The fuel injector of claim 21 wherein the delay device shifts from the first disposition responsive to high pressure fuel generating a force on the delay device in opposition to the bias.

23. The fuel injector of claim 22 wherein the delay device is disposed relative to a fluid passageway, the fluid passageway being in fluid communication with the injector nozzle, such that shifting of the delay device acts to open and close the passageway.

24. The fuel injector of claim 23 wherein the delay device is a piston disposed in a cylinder, the passageway intersecting the cylinder.

25. The fuel injector of claim 24 wherein the piston is biased in the first disposition by a spring acting thereon.

26. The fuel injector of claim 25 wherein the piston is translatably disposed at least in part in a cylinder defined in an injector housing.

27. A method of controlling fuel injection events, comprising the steps of:

sending a pulse width command to a controller to define an injection event;

flowing an actuating fluid from the controller to affect an intensifier responsive to reception of the pulse width command;

pressurizing a volume of fuel by means of the intensifier;

flowing a high pressure fuel from the intensifier to an injector nozzle;

interposing a delay in at least a portion of the flow of fuel to the injector nozzle, the delay being imposed by a fluidly actuated, translatable delay device; and selectively throttling the flow of the pressurized fuel to the delay device.

28. The method of claim 27 wherein a small portion of the flow of fuel to the injector nozzle is not delayed to provide pilot injection.

29. The method of claim 27 wherein a period of injection rate shaping is concurrent with the period of delay.

30. The method of claim 27 wherein the delay is effected by selectively opening and closing an actuating fluid passageway by means of the translatory motion of a delay piston.

31. The method of claim 30 wherein the translatory motion of the delay piston is effected in part by the high pressure fuel acting on the delay piston.

32. The injector of claim 2 further including a second fuel passageway, the second fuel passageway fluidly coupling the delay piston to the injector nozzle, fluid pressure in the second fuel passageway acting to generate a force on the injector nozzle for imparting translatory opening motion thereto.

33. The injector of claim 32 wherein the second fuel passageway intersects the delay piston cylinder between a first disposition and a second disposition of the delay device.

34. The injector of claim 33 wherein the second fuel passageway is substantially sealed by the delay piston when the delay piston is in the first disposition.

35. The injector of claim 34 wherein translation of the delay piston from the first disposition toward the second disposition acts to open the second fuel passageway after a selected distance of delay piston travel.

36. The injector of claim 32 wherein a third fuel passageway intersects the second fuel passageway for conveying a volume of pressurized fuel thereto, the third fuel passageway having a relatively small flow area for restricting the volume of fuel flowing therein, such restriction effecting a rate shaped injection event.

37. The injector of claim 36 wherein the third fuel passageway is in fluid communication with the plunger chamber.

38. The injector of claim 36 wherein the third fuel passageway is open to the flow of fuel without regard to the position of the delay piston.

39. The delay device of claim 1 being both selectively throttled and selectively fluidly damped translational motion between the first and second dispositions.

40. The delay device of claim 39 including a throttling orifice for throttling the flow of pressurized actuating fuel.

41. The delay device of claim 40 the throttling orifice being in fluid communication with a source of pressurized actuating fuel and with a variable volume control chamber.

42. The delay device of claim 41 the variable volume control chamber being defined in part by an actuating surface of a translatable piston.

43. The delay device of claim 42 the throttling orifice being defined in a fluid passageway defined in the translatable piston, the fluid passageway intersecting the actuating surface.

44. The delay device of claim 39 including a damping orifice, the damping orifice being in fluid communication with a reservoir for controlling the flow of actuating fuel from the reservoir.

45. The delay device of claim 44, the reservoir being variable in volume and being formed in part by a reservoir surface of a translatable piston.

46. The delay device of claim 44, the reservoir being defined at a first piston end and a control chamber being defined at an opposed second piston end.

47. The fuel injector of claim 15 being both selectively throttled and selectively fluidly damped translational motion between the first and second dispositions.

48. The fuel injector of claim 47 including a throttling orifice for throttling the flow of pressurized actuating fuel.

49. The fuel injector of claim 48 the throttling orifice being in fluid communication with a source of pressurized actuating fluid and with a variable volume control chamber.

50. The fuel ejector of claim 49 the variable volume control chamber being defined in part by an actuating surface of a translatable piston.

51. The fuel injector of claim 50 the throttling orifice being defined in a fluid passageway defined in the translatable piston, the fluid passageway intersecting the actuating surface.

52. The fuel injector of claim 47 including a damping orifice, the damping orifice being in fluid communication with a reservoir for controlling the flow of fuel from the reservoir.

53. The fuel injector of claim 52, the reservoir being variable in volume and being formed in part by a reservoir surface of a translatable piston.

54. The fuel injector of claim 52, the reservoir being defined at a first piston end and a control chamber being defined at an opposed second piston end.

55. The method of claim 27 including selectively damping the translation of the delay device.

56. The fuel injector of claim 1 including a throttling orifice for throtting the flow of pressurized fuel.

57. The fuel injector of claim 56 the throttling orifice being in fluid communication with a source of pressurized fuel and with a variable volume control chamber.

58. The fuel injector of claim 57 the variable volume control chamber being defined in part by an actuating surface of a translatable piston.

59. The fuel injector of clam 58 the throttling orifice being defined in a fluid passageway defined in the translatable piston, the fluid passageway intersecting the actuating surface.

60. The fuel injector of claim 56 including a damping orifice, the damping orifice being in fluid communication with a reservoir for controlling the flow of fuel from the reservoir.

61. The fuel injector of claim 60, the reservoir being variable in volume and being formed in part by a reservoir surface of a translatable piston.

62. The fuel injector of claim 60, the reservoir being defined at a first piston end and a control chamber being defined at an opposed second piston end.

* * * * *